United States Patent [19]

Summers et al.

[11] Patent Number: 4,932,213

[45] Date of Patent: Jun. 12, 1990

[54] METHOD OF TREATING NATURAL GAS TO REMOVE ETHANE AND HIGHER HYDROCARBONS

[75] Inventors: David L. Summers, Katy, Tex.; Donald A. Martin, Northwest Calgary, Canada

[73] Assignee: Amoco Corporation, Chicago, Ill.

[21] Appl. No.: 309,584

[22] Filed: Feb. 10, 1989

[51] Int. Cl.[5] ..... F25J 3/06

[52] U.S. Cl. ..... 62/23; 62/43

[58] Field of Search ..... 62/9, 11, 23, 42, 43

[56] References Cited

U.S. PATENT DOCUMENTS

| | | | |
|---|---|---|---|
| 3,754,405 | 8/1973 | Rosen | 62/11 |
| 3,874,184 | 4/1975 | Harper et al. | 62/9 |
| 4,217,759 | 8/1980 | Shenoy | 62/23 |
| 4,267,701 | 5/1981 | Toscano | 62/9 |
| 4,566,886 | 1/1986 | Fabian et al. | 62/11 |
| 4,619,679 | 10/1986 | DeLong | 62/11 |

*Primary Examiner*—Ronald C. Capossela

*Attorney, Agent, or Firm*—L. W. White; F. E. Hook

[57] ABSTRACT

A high pressure stream of natural gas is treated to remove ethane and higher boiling point hydrocarbons and to produce a low pressure stream of pipeline gas and a high pressure stream of pipeline gas. The method comprises the steps of:

(a) passing at least a portion of said high pressure stream of natural gas sequentially through:

(1) a first heat exchanger where said stream of natural gas is cooled, (2) a Joule-Thompson valve where said stream of natural gas is expanded adiabatically and the temperature and pressure of the stream are each reduced sufficiently to cause ethane and high boiling fluids to condense, and (3) a first gas/liquid separator where a stream of low pressure pipeline gas is separated from condensed fluids;

(b) withdrawing the low pressure pipeline gas from said first separator and flowing it through said first heat exchanger, where the gas is warmed, and into a pipeline or other suitable collector; and (c) withdrawing the condensed fluids from said first separator.

4 Claims, 1 Drawing Sheet

METHOD OF TREATING NATURAL GAS TO REMOVE ETHANE AND HIGHER HYDROCARBONS

BACKGROUND OF THE INVENTION

1. Field of the Invention

This invention pertains to an energy efficient method of removing ethane and higher boiling hydrocarbons from a high pressure stream of natural gas.

2. Description of the Prior Art

Natural gas from oil and gas wells is typically produced as a gaseous mixture of methane, ethane, and higher boiling hydrocarbons, but it is primarily methane. Natural gas can also contain water, hydrogen sulfide, and other gaseous or entrained components. All of the chemical components of natural gas have value as does the chemical gemisch. However, some of the components or component mixtures are more valuable than others. E.g., sweetened natural gas is more valuable than sour natural gas because the toxic/noxious hydrogen sulfide has been removed and the health/environmental problems associated with hydrogen sulfide have been reduced or eliminated.

Natural gas is primarily marketed and used as a gaseous hydrocarbon fuel, and it is conveyed from the well to the market by a network of pipelines and storage facilities. Unfortunately, some of the hydrocarbon components and/or moisture in natural gas condense under certain conditions of temperature and pressure as the gas is transported through pipelines or stored. The presence of water in gas may cause hydrate formation with the resultant precipitation of solids which can plug lines and valves. Water condensed from natural gas may also increase corrosion of pipelines through which the gas is transmitted if the gas contains carbon dioxide or hydrocarbon sulfide.

In addition, the concentration of higher boiling point hydrocarbons, especially propane and butane, sometimes is high enough to cause condensation of liquid hydrocarbons at the high pressures in the pipeline. The liquid can collect in low spots and cause slugging through the pipeline which interferes with the transmission of the gas. To avoid condensation of water or hydrocarbons, natural gas pipeline companies specify maximum moisture and hydrocarbon dew points for gas that they purchase.

To reduce the dew points of natural gas delivered to pipelines, the gas is frequently treated at gathering points to remove moisture and hydrocarbons that may condense before transmission through pipelines. One conventional treatment at natural gasoline plants passes the gas through an absorption tower in contact with an absorbent oil which removes higher boiling point hydrocarbons from the gaseous stream. The rich oil is then passed through a stripper where the volatile hydrocarbons are removed from the oil. The absorbent oil is recycled through the absorber and the stripped hydrocarbons are delivered to a fractionating system for separation of the hydrocarbons to produce a liquid product having a vapor pressure allowing it to be safely stored in LPG vessels. More recently, natural gas plants have used a turboexpander refrigeration system for the separation of higher boiling point hydrocarbons from methanes. A natural gasoline plant of either type is expensive and cannot be justified at many small fields.

Patents disclosing the treatment of natural gas to separate methane from other constituents of the natural gas are: U.S. Pat. Nos. 2,134,702; 3,285,719; 3,292,380; 3,494,751; 3,596,472; 4,128,410. The last patent in this nonexhaustive list is particularly concerned with the removal of water from natural gas, as is U.S. Pat. No. 4,522,636 which adds methanol to the natural gas before treatment. The disclosure of U.S. Pat. No. 4,522,636 is hereby incorporated by reference. Other techniques have been described which attempt to convert natural gas to "pipeline gas" or "pipeline quality gas," as it is typically referred to in the industry. This invention is also direct to a method of obtaining pipeline quality gas.

SUMMARY OF THE INVENTION

A new method has now been discovered for treating a high pressure stream of natural gas to remove ethane and higher boiling point hydrocarbons and to produce a low pressure stream of pipeline gas and a high pressure stream of pipeline gas. The method comprises the steps of:

(a) passing at least a portion of said high pressure stream of natural gas sequentially through:
  (1) a first heat exchanger where said stream of natural gas is cooled,
  (2) a Joule-Thompson valve where said stream of natural gas is expanded adiabatically and the temperature and pressure of the stream are each reduced sufficiently to cause ethane and high boiling fluids to condense, and
  (3) a first gas/liquid separator where a stream of low pressure pipeline gas is separated from condensed fluids;

(b) withdrawing the low pressure pipeline gas from said first separator and flowing it through said first heat exchanger, where the gas is warmed, and into a pipeline or other suitable collector; and (c) withdrawing the condensed fluids from said first separator.

DETAILED DESCRIPTION OF THE INVENTION

Figure 1:
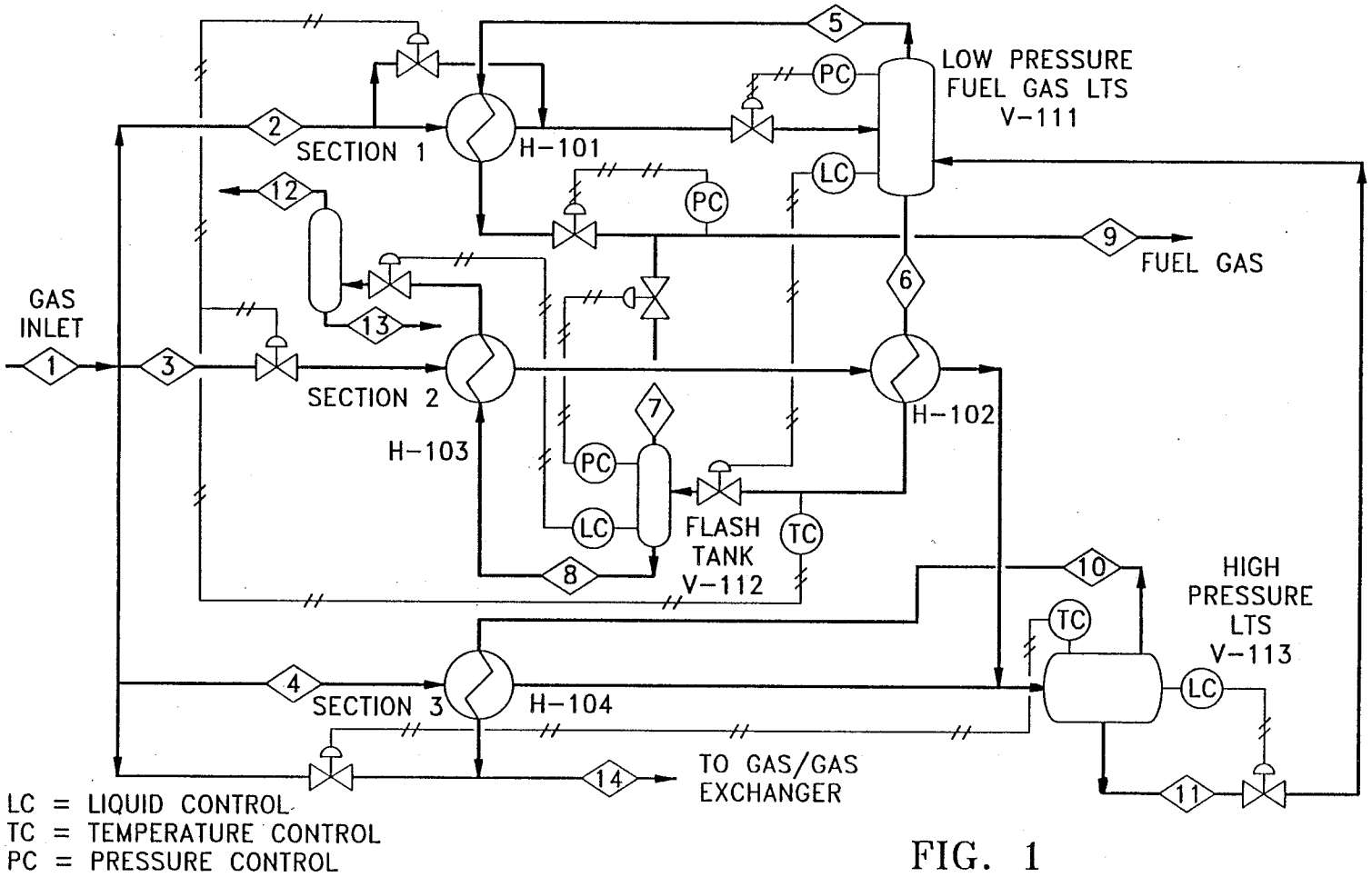
FIG. 1 is a schematic representation of the process facility described in the example below.

The high pressure stream of natural gas is preferably split into at least two process streams, one of which is diverted into a low pressure section of the treating plant and the other(s) into a high pressure section of the treating plant. In the low pressure section, the first process stream is passed sequentially through: (1) a first heat exchanger where the process stream is cooled, (2) a Joule-Thompson valve where the process stream is expanded adiabatically and the temperature and pressure of the stream are each reduced sufficiently to cause ethane and higher boiling fluids to condense, and (3) a first gas/liquid separator where a stream of low pressure pipeline gas is separated from condensed fluids. The low pressure pipeline gas is withdrawn from said first separator and flowed through the first heat exchanger, where the gas is warmed, and into a pipeline or other suitable collection vessel. The condensed fluids from said first separator are withdrawn as a first liquid stream and flowed sequentially through: (1) a second heat exchanger, where it is warmed, and (2) a flash tank, where it is devolatilized to remove residual methane, ethane, and other dissolved or entrained gases. The warmed, devolatilized first liquid stream is then discharged into a pipeline or other suitable collection vessel. In the high pressure section of the plant, a second process stream is passed sequentially through: (1) the second heat exchanger, where it is cooled sufficiently to cause ethane and higher boiling fluids to condense, and (2) a second gas/liquid separator where a stream of high pressure plant residue gas is separated from condensed fluids. The high pressure plant residue gas is withdrawn from said second separator and flowed into a pipeline or other suitable collection vessel. The condensed fluids from the second separator are withdrawn as a second liquid stream and introduced into said first separator where the fluids are combined.

The high pressure stream of natural gas is most preferably split into three process streams, one of which is diverted into a low pressure section of the treating plant and the other two into a high pressure section of the treating plant. In the low pressure section, the first process stream is treated as set forth above, except for the treatment of the first liquid stream of condensed fluids. In this embodiment, the first fluid liquid stream is flowed flowing said first liquid stream sequentially through: (1) a second heat exchanger wherein the liquid stream is warmed, (2) a flash tank wherein any residual methane which was dissolved or entrained in the liquid stream is volatilized, stripped from the liquid stream and combined with said low pressure stream of pipeline gas in the pipeline or collection vessel, and (3) a third exchanger wherein the liquid stream is warmed and discharged as a low pressure liquid into a pipeline or suitable collection vessel. In the high pressure section of the treating plant, the second process stream is passed sequentially through: (1) the third heat exchanger and the second heat exchanger wherein it is cooled sufficiently to cause ethane and higher boiling point fluids to condense, (2) a second gas/liquid separator wherein a first stream of high pressure plant residue gas is separated from a second liquid stream comprising ethane and higher boiling hydrocarbons. The stream of high pressure plant residue gas is flowed through a fourth heat exchanger wherein it is warmed and discharged into a pipeline or suitable collection vessel. The second liquid stream from the second gas/liquid separator is withdrawn and introduced into the first gas/liquid separator where it is combined with said first liquid stream and the combined liquids thereafter treated as said first liquid stream, as noted above. The third process stream is passed sequentially through: (1) said fourth heat exchanger, where it is cooled, and (2) said second gas/liquid separator wherein a second stream of high pressure plant residue gas is separated from a third liquid stream comprising ethane and higher boiling hydrocarbons and wherein said first stream and second stream of high pressure plant residue gas are combined and the combined gas is treated as said first high pressure plant residue gas stream, as noted above, and wherein the second and third liquid streams are combined and the combined liquid treated as the second liquid stream, as noted above. Generally, the cooled gaseous second and third process streams are combined prior to introducing the streams into said second separator, as illustrated in FIG. 1.

The energy efficiency of the overall process is improved substantially by passing the cooled gas and liquid from the first gas/liquid separator through the various heat exchangers as set forth above and more fully illustrated in the following example.

EXAMPLE

The particular plant in FIG. 1 is designed to process 15 million standard cubic feet of gas per day (mmscf/day) inlet at an inlet temperature of 50° F. or up to 18 mmscf/day at 0° F. The plant uses a series of back exchangers to not only optimize NGL recovery from the fuel gas section of the plant but also to extract liquid from high pressure gas by using available excess cooling duty. In order to simplify explanation of the plant, the following designations will be used in FIG. 1 and in the following text:

(1) Section 1 - low pressure fuel gas section
(2) Section 2 - primary high pressure section
(3) Section 3 - secondary high pressure section

Section 1 - Low Pressure Fuel Gas Section

Plant inlet gas (1) is split into three streams, one stream (2) is processed in the fuel gas (low pressure) section of the plant, while the remaining streams (3) and (4) are processed in the high pressure section and sent to fuel gas sales. Inlet gas (2) to section 1 is cooled through a gas/gas exchanger upstream of the Joule-Thompson valve. Pressure drop across this valve (950 psig to 200 psig) is constantly monitored by a pressure controller. The low pressure gas enters a stainless steel fuel gas separator, V-111, where vapor off this vessel (5) is used for back exchange with inlet gas (H - 101) to this section of the plant. A second stream, (11) - liquid from the high pressure low temperature separator, is fed into the low pressure fuel gas separator scrubber and flashed; this is discussed in more detail below. A combined liquid stream off the fuel gas scrubber is level controlled through gas/liquid exchangers in the high pressure section 2 of the plant; this will also be discussed below. In order to maintain appropriate temperatures in other areas of the plant, an inlet bypass valve is installed to route section 1 inlet gas around the inlet exchanger, if necessary.

Sections 2 and 3 - High Pressure (Residue Sales Gas) Processing

Inlet gas to section 2 is introduced through stream (3). The gas is cooled in two steps by series exchanging with cold liquid generated in the low pressure fuel gas section of the plant. Primary exchange takes place in the second of two gas/liquid exchangers H-102 where liquid (6) is warmed from about −100° F. to about −40° F. The liquid is then flashed to remove as much methane and ethane as possible before proceeding to the next exchanging stage H-103. In exchanger H-103, inlet gas (3) is first cooled and the liquid (8) is warmed to 40° F., liquid proceeds from this point to storage (13) at 150 psig. After passing through both gas/liquid exchangers, the high pressure gas (3) enters the (high pressure) low temperature separator. Liquids from this vessel (11) are fed to the low pressure fuel gas separator where they are mixed with the fuel gas liquids and used for cooling high pressure inlet gas. Gas flow to this section of the plant (3) is regulated via temperature control which maintains liquid temperature out of H-102 at −40° F. Inlet gas to section 3 of the plant (4) is cooled in a gas/gas exchanger H-104 by vapor (10) off the high pressure LTS. The resulting cold gas joins gas from the section 2 and enters the high pressure separator, V-113. Gas flow to section 3 of the plant flows depending on demands in the first two sections of the plant. A master bypass valve controlled by temperature in the high pressure separator will route gas (14) back to the main treating unit when it is not required.

The operating conditions are summarized in Table I below.

TABLE I

| Operating Conditions Summary | |
|---|---|
| Total Plant Inlet | 15.0 mmscf/d Plant |
| Plant Inlet Pressure | 950 psia |
| Plant Inlet Temperature | 50° F. |
| Section 1 | |
| Total Fuel | 6.0 mmscf/d |
| Fuel Gas LTS Pressure | 200 psia |
| Temperature | −100° F. |
| Fuel Gas Exchanger Duty | .85 mmbtu/hr |
| Section 2 | |
| Flash Tank Pressure | 175 psia |
| Temperature | −43° F. |
| Product Temperature | 40° F. |
| Liquid/Gas Exchanger Duties | |
| Primary (2nd) | .16 mmbtu/hr |
| Secondary | .22 mmbtu/hr |
| Section 3 | |
| High Pressure LTS Temperature | −40° F. |
| Exchanger Duty | 1.0 mmbtu/hr |

Detailed operating conditions are shown in Table II below.

TABLE II

| Stream Number | 1 | 2 | 3 | 4 | 5 | 6 | 7 | 8 | 9 | 10 | 11 | 12 | 13 |
|---|---|---|---|---|---|---|---|---|---|---|---|---|---|
| Vapour Fraction | 1.0 | .98 | .98 | .98 | 1.0 | 0.0 | 1.0 | 0.0 | 1.0 | 1.0 | 0.0 | 1.0 | 0.0 |
| Temperature F. | 50 | 50 | 50 | 50 | −100 | −100 | −43 | −43 | 40 | −40 | −40 | 40 | 40 |
| Pressure psi | 950 | 950 | 950 | 950 | 200 | 200 | 175 | 175 | 200 | 925 | 925 | 150 | 150 |
| Molecular Wt. | 18.8 | 18.8 | 18.8 | 18.8 | 17.3 | 39.8 | 20.2 | 44.5 | 17.8 | 17.8 | 28.8 | 31 | 50.0 |
| MMSCF/Day | 15.0 | — | — | — | 6.0 | — | .153 | — | 6.153 | 8.20 | — | .01 | — |
| US ggm | — | — | — | — | — | 14.60 | — | 12.50 | — | — | 11.60 | — | 9.62 |
| $N_2$ | 11.70 | 4.70 | 1.27 | 5.71 | 4.85 | .03 | .03 | — | 4.88 | 6.80 | .18 | — | — |
| $CO_2$ | 14.70 | 5.89 | 1.60 | 7.15 | 6.00 | .78 | .30 | .50 | 6.30 | 7.86 | .90 | — | .15 |
| $C_1$ | 1446.80 | 582.00 | 158.25 | 706.65 | 610.51 | 20.00 | 12.85 | 7.25 | 623.36 | 810.23 | 48.65 | .21 | 1.00 |
| $C_2$ | 104.60 | 42.06 | 11.44 | 41.07 | 32.85 | 21.50 | 2.90 | 18.60 | 35.75 | 50.24 | 12.28 | .35 | 10.30 |
| $C_3$ | 43.15 | 17.35 | 4.72 | 21.07 | 4.20 | 23.50 | .62 | 22.95 | 4.82 | 15.40 | 10.40 | .17 | 19.00 |
| $iC_4$ | 6.75 | 2.70 | .74 | 3.30 | .19 | 4.86 | .04 | 4.82 | .23 | 1.70 | 2.34 | .01 | 4.47 |
| $C_4$ | 10.54 | 4.24 | 1.15 | 5.15 | .17 | 8.15 | .04 | 8.10 | .21 | 2.22 | 4.00 | .02 | 7.68 |
| $iC_5$ | 2.80 | 1.12 | .30 | 1.37 | .01 | 2.43 | — | 2.43 | .01 | .36 | 1.30 | — | 2.38 |
| $C_5$ | 2.47 | 1.00 | .27 | 1.20 | — | 2.20 | — | 2.20 | — | .26 | 1.22 | — | 2.17 |
| $C_6$ | 1.81 | .73 | .20 | .88 | — | 1.73 | — | 1.73 | — | .08 | 1.00 | — | 1.72 |
| $C_7$ | .82 | .33 | .09 | .40 | — | .80 | — | .81 | — | .01 | .48 | — | .80 |
| $C_8$ | .50 | .20 | .05 | .24 | — | .50 | — | .50 | — | — | .29 | — | .50 |
| $C_9$ | .33 | .13 | .05 | .16 | — | .33 | — | .33 | — | — | .20 | — | .33 |
| Total lbmole/hr | 1646.97 | 662.45 | 180.13 | 804.35 | 658.81 | 86.81 | 16.78 | 70.20 | 675.59 | 901.15 | 83.24 | .77 | 50.50 |

The inlet gas had the chemical composition shown in Table III.

TABLE III

| Inlet Gas Analysis | |
|---|---|
| Component | Moles |
| $N_2$ | .0071 |
| $CO_2$ | .0089 |
| $C_1$ | .8785 |
| $C_2$ | .0635 |
| $C_3$ | .0262 |
| $IC_4$ | .0041 |
| $NC_4$ | .0064 |
| $IC_5$ | .0017 |
| $NC_5$ | .0015 |
| $C_6$ | .0011 |
| $C_7$ | .0005 |
| $C_8$ | .0003 |
| $C_9$ | .0002 |
| $C_{10}$ | — |

What is claimed is:

1. A method of removing ethane and higher boiling fluids from a high pressure stream of natural gas and for concurrently producing a low pressure stream of pipeline gas, said method comprising the steps of:

(a) passing at least a portion of said high pressure stream of natural gas sequentially through:

(1) a first heat exchanger where said stream of natural gas is cooled, (2) a Joule-Thompson valve where said stream of natural gas is expanded adiabatically and the temperature and pressure of the stream are each reduced sufficiently to cause ethane and high boiling fluids to condense, and (3) a first gas/liquid separator where a stream of low pressure pipeline gas is separated from condensed fluids;

(b) withdrawing the low pressure pipeline gas from said first separator and flowing it through said first heat exchanger, where the gas is warmed, and into a pipeline or other suitable collector; and (c) withdrawing the condensed fluids from said first separator.

2. A method of removing ethane and higher boiling fluids from a high pressure stream of natural gas and for concurrently producing a low pressure stream of pipeline gas and a high pressure stream of plant residue gas, said method comprising the steps of:

(a) splitting the high pressure stream of natural gas into at least two process streams;

(b) diverting a first process stream into a low pressure section of a treating plant and passing said first process stream sequentially through:

(1) a first heat exchanger where the process stream is cooled, (2) a Joule-Thompson valve where the process stream is expanded adiabatically and the temperature and pressure of the stream are each reduced sufficiently to cause ethane and higher boiling fluids to condense, and (3) a first gas/liquid separator where a stream of low pressure pipeline gas is separated from condensed fluids; and (c) withdrawing the low pressure pipeline gas from said first gas/liquid separator and flowing it through said first heat exchanger, where the gas is warmed, and into a pipeline or other suitable collection vessel;

(d) withdrawing the condensed fluids from said first gas/liquid separator as a first liquid stream and flowing it sequentially through
  (1) a second heat exchanger, where it is warmed, and
  (2) a flash tank, where it is devolatilized to remove residual methane, ethane, and other dissolved or entrained gases, and discharging the warmed, devolatilized first liquid stream into a pipeline or other suitable collection vessel;
(e) diverting a second process stream into a high pressure section of said treating plant and passing said second process stream sequentially through:
  (1) said second heat exchanger where it is cooled sufficiently to cause ethane and higher boiling fluids to condense, and
  (2) a second gas/liquid separator where a stream of high pressure plant residue gas is separated from condensed fluids;
(f) withdrawing the high pressure plant residue gas from said second gas/liquid separator and flowing it into a pipeline or other suitable collection vessel; and
(g) withdrawing the condensed fluids from said second gas/liquid separator as a second liquid stream and introducing it into said first gas/liquid separator.

3. A method of treating a high pressure stream of natural gas to remove ethane and higher boiling point hydrocarbons therefrom and to produce a low pressure stream of pipeline gas and a high pressure stream of plant residue gas, said method comprising the steps of:
(a) splitting the high pressure stream of natural gas into a first process stream, a second process stream and a third process stream;
(b) passing said first stream sequentially through:
  (1) a first heat exchanger where it is cooled,
  (2) a Joule-Thompson valve where the pressure and temperature are each reduced sufficiently to cause ethane and higher boiling point hydrocarbons to liquify, and
  (3) a first gas/liquid separator where a stream of low pressure pipeline gas is separated from a first liquid comprising ethane and higher boiling point hydrocarbons;
(c) flowing said stream of low pressure pipeline gas through said first heat exchanger wherein the pipeline gas is warmed and discharged as a low pressure stream of pipeline gas into a pipeline or suitable collection vessel;
(d) flowing said first liquid stream sequentially through:
  (1) a second heat exchanger wherein the liquid stream is warmed,
  (2) a flash tank wherein any residual methane which was dissolved or entrained in the liquid stream is volatilized, stripped from the liquid stream and combined with said low pressure stream of pipeline gas in said pipeline or collection vessel, and
  (3) a third exchanger wherein the liquid stream is warmed and discharged as a low pressure liquid into a pipeline or suitable collection vessel,
(e) passing said second process stream sequentially through:
  (1) said third heat exchanger and said second heat exchanger wherein it is cooled sufficiently to cause ethane and higher boiling point hydrocarbons to condense, and
  (2) a second gas/liquid separator wherein a first stream of high pressure plant residue gas is separated from a second liquid stream comprising ethane and higher boiling hydrocarbons;
(f) flowing said stream of high pressure plant residue gas through a fourth heat exchanger wherein it is warmed and discharged into a pipeline or suitable collection vessel;
(g) flowing said second liquid stream into said first gas/liquid separator where it is combined with said first liquid stream and the combined liquids thereafter treated as said first liquid stream per step (d) above; and
(h) passing said third stream sequentially through:
  (1) said fourth heat exchanger, where it is cooled, and
  (2) said second gas/liquid separator wherein a second stream of high pressure plant residue gas is separated from a third liquid stream comprising ethane and higher boiling hydrocarbons and wherein said first stream and second stream of high pressure plant residue gas are combined and the combined gas is treated as said first high pressure pipeline gas stream in step (f) above; and wherein said second and third liquid streams are combined and the combined liquid treated as said second liquid stream in step (g) above.

4. The method defined by claim 3 wherein the cooled gaseous second and third streams are combined prior to introducing the streams into said second separator.

* * * * *